US005222350A

United States Patent [19]

Bowman et al.

[11] Patent Number: 5,222,350

[45] Date of Patent: Jun. 29, 1993

[54] ROVING FRAME AND METHOD

[75] Inventors: Paul W. Bowman, Greenville; Frederick A. Preston, Pendleton; John W. Gillespie; Erhard E. Stiepel, both of Seneca; Timothy D. Winchester, Easley, all of S.C.

[73] Assignee: Platt Saco Lowell Corporation, Greenville, S.C.

[21] Appl. No.: 624,017

[22] Filed: Dec. 6, 1990

[51] Int. Cl.[5] ..... D01H 9/10; D01H 9/14

[52] U.S. Cl. ..... 57/267; 57/277; 57/281

[58] Field of Search ..... 57/267, 276, 266, 274, 57/275, 277, 288, 66, 67, 71, 281

[56] References Cited

U.S. PATENT DOCUMENTS

| | | | |
|---|---|---|---|
| 2,716,326 | 8/1955 | Colvin | 57/266 |
| 3,357,170 | 12/1967 | Pfeifer | 57/67 |
| 3,935,699 | 2/1976 | Iida et al. | 57/267 |
| 4,369,621 | 1/1983 | Kogiso | 57/267 |
| 4,757,679 | 7/1988 | Marzoli | 57/267 |
| 4,781,015 | 11/1988 | Dinkelmann et al. | 57/100 X |
| 4,805,352 | 2/1989 | Grassle et al. | 57/267 |
| 4,893,460 | 1/1990 | Wolf | 57/100 X |
| 4,934,132 | 6/1990 | Marzoli | 57/267 |
| 4,987,734 | 1/1991 | Meyer | 57/100 |
| 5,022,223 | 6/1991 | Mena | 57/267 |

*Primary Examiner*—Daniel P. Stodola
*Assistant Examiner*—Michael R. Mansen
*Attorney, Agent, or Firm*—Bailey & Hardaway

[57] ABSTRACT

A roving frame apparatus and method for winding roving upon bobbins (A) and doffing full packages directly upon a conveyor (F) wherein a spindle rail (C) is moved laterally beneath an overhead conveyor removing full packages therefrom and supplying empty bobbins thereto.

5 Claims, 16 Drawing Sheets

Fig. 22.
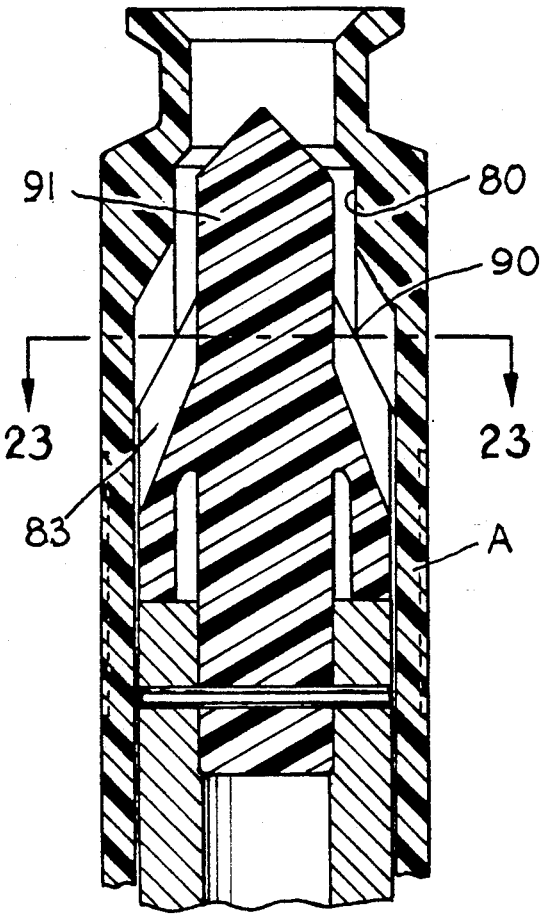
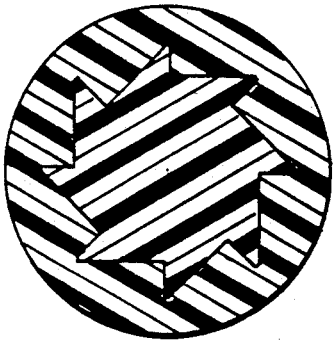
Fig. 25.
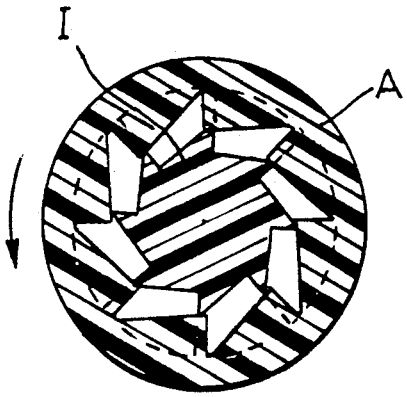
Fig. 23.
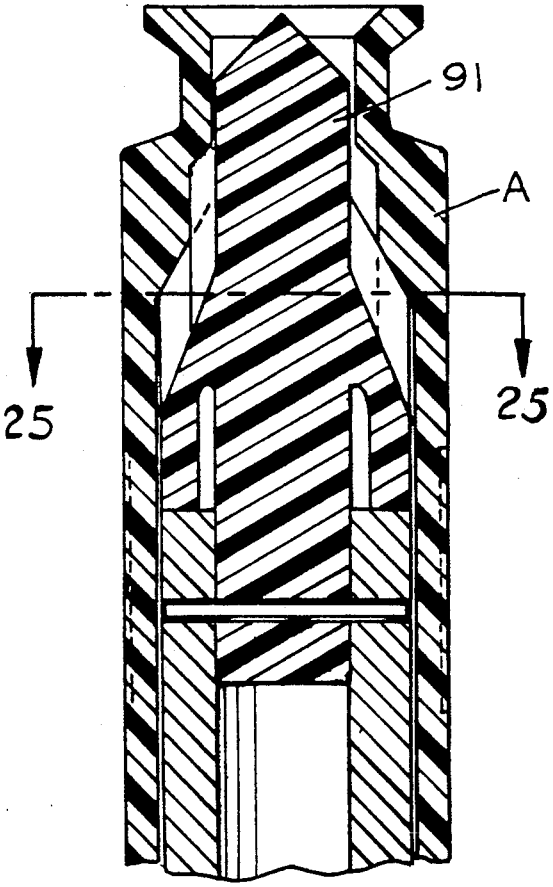
Fig. 24.

ROVING FRAME AND METHOD

BACKGROUND OF THE INVENTION

The manual doffing of a textile machine such as a roving frame producing a large number of spaced strand packages requires repetitive motions in removing one package after another with placement of each package in a cart. This task of mill personnel known as doffers is so onerous that many attempts have been made to automate the doffing phase of producing roving packages from sliver strands.

Because of the stationary positioning of the flyers above the traversing spindle rail it is difficult to doff a roving frame from the front. An attempt to automate roving frame operation is exemplified by the roving frame illustrated in U.S. Pat. No. 4,757,679 wherein full bobbins are doffed from a forwardly tilted position all at one time on a conveyor which thereafter manipulates them onto a doffing carriage. In a reverse operation empty bobbins are then placed on the spindles.

Another attempt to automate roving frame operation is illustrated in U.S. Pat. No. 4,934,132 wherein a conveyor is positioned in front of a roving frame to receive full bobbins and replace with empty bobbins upon a support which is moved forwardly into vertical alignment with the vertically movable conveyor.

Heretofore, it is necessary to stop the roving frame upon the occurrence of ends down or a faulty roving. This is because such roving machines have a common drive for all spindles and flyers. This practice results in excessive bobbin down time.

Accordingly, it is an important object of the present invention to facilitate automatic doffing by utilizing the spindle rail to doff directly upon a transport conveyor which can also supply empty bobbins automatically to the spindles.

Another important object of the invention is the provision of independent motor drives to each spindle or as a group carried on the rail independently of any other mechanical connection.

Another object of the invention is the provision of a method of doffing and replacement of roving bobbins utilizing indexing of a transport conveyor and raising and lowering of the rail.

Another object of the invention is the provision of a conveyor utilizing an endless belt with longitudinally spaced transverse doffing brackets with apparatus for automatically loading and unloading bobbins.

Another object of the invention is the provision of a control for individual spindles to avoid down time which occurs when every delivery is deactivated as a result of a faulty roving strand.

Another object of the invention is the provision of a novel roving bobbin which may be suspended from a tip.

Still another object of the invention is the provision of a novel spindle upon which the bobbins are self seating.

SUMMARY OF THE INVENTION

It has been found that a more fully automated roving frame may be provided by utilizing the traversing spindle rail for doffing directly to a conveyor for transport as to a spinning frame. The spindle rail is moved downwardly and then rearwardly to doff full roving bobbins from and to supply empty roving bobbins to the spindles, moving up and down in the process. Preferably each of the spindles and its associated flyers are provided with an individual drive motor which is both independent of any other mechanical connection and which may be individually deactivated by a monitoring device to stop only one sliver delivery.

The roving bobbins are suspended by a tip on each bobbin on transverse conveyor brackets at each end of the respective brackets and are self seating upon the spindles by camming surfaces internal to the bobbin adjacent the bobbin tip and external to a tip of the spindle for guiding the bobbins longitudinally and for rotating them bringing interlocking driving surfaces into engagement. The roving bobbins may be removed from the conveyor by rotating an arm beneath each end of the respective brackets and moving the full bobbins in a horizontal plane away from the bracket. Empty roving bobbins may be supplied replacing full bobbins by rotating said arms carrying empty bobbins above the brackets.

A monitoring device is provided at each delivery for exerting individualized control over the operation of each spindle.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1-A is a schematic front perspective view illustrating flyer and spindle drives constructed in accordance with a modified form of the invention;

FIG. 22 is a sectional elevation illustrating a bobbin when first received upon the spindle prior to seating;

FIG. 23 is a sectional plan view taken on the lines 23—23 in FIG. 22;

FIG. 24 is a sectional elevation with the bobbin seated and the driving surfaces engaged;

FIG. 25 is a sectional plan view with the bobbin seated taken on the line 25—25 in FIG. 24;

DESCRIPTION OF A PREFERRED EMBODIMENT

Figure 1:
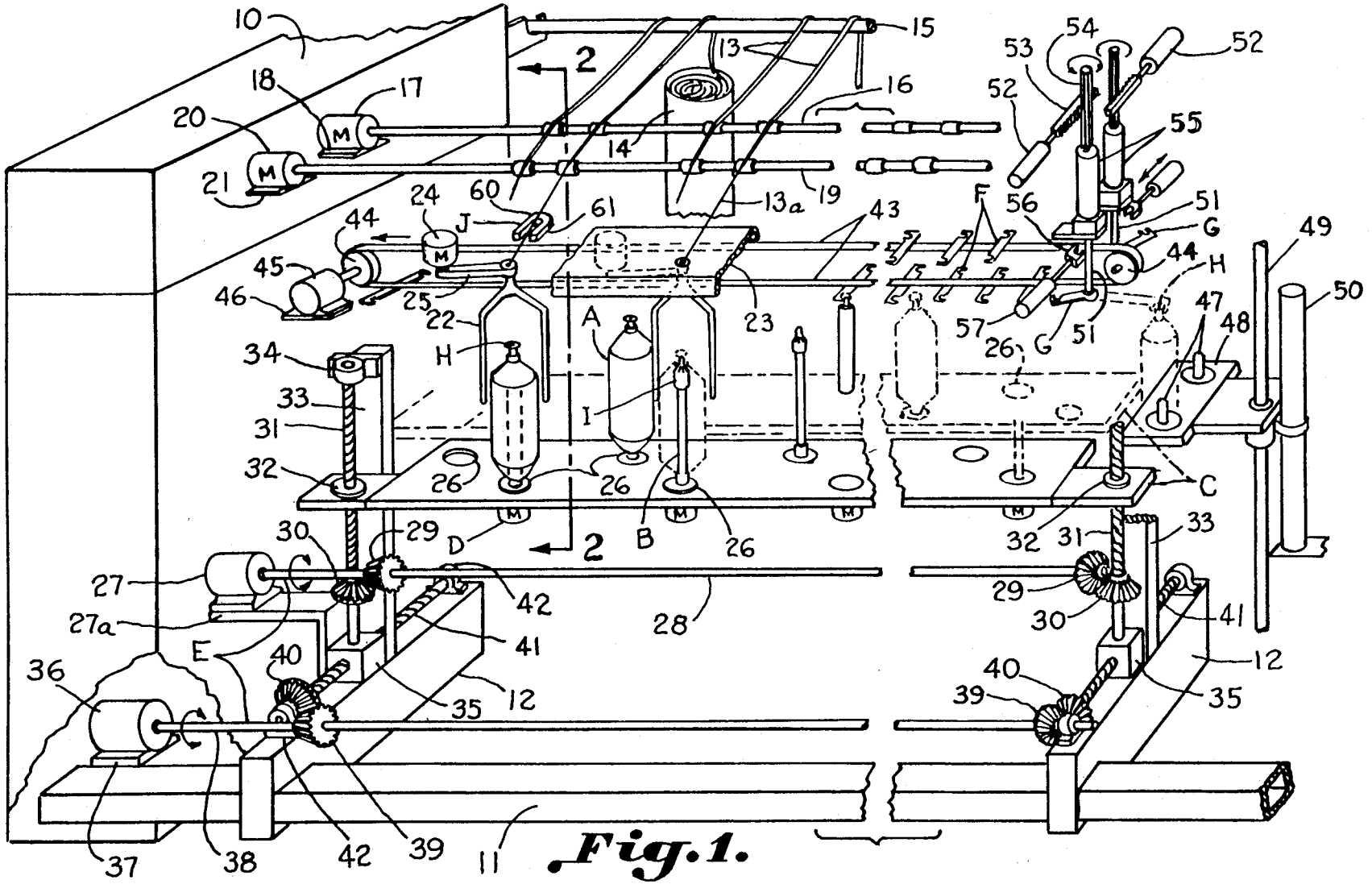
FIG. 1 is a schematic front perspective view with parts omitted illustrating a roving frame constructed in accordance with the invention with the traversing spindle rail in forward position.

A roving frame and method is illustrated including apparatus for doffing roving bobbins A supported upon spindles B carried upon a traversing spindle rail C. Spindle drives D are carried upon the traversing rail driving each of the spindles independently of connection to any other drive mechanism. A transfer drive E moves the rail downwardly and then laterally rearwardly of a winding position to a doffing position and up and down to facilitate doffing. Spaced supports, which may include longitudinally spaced transverse brackets F, receive full roving bobbins when the rail is in doffing position. Means including rotating arms G are provided for loading and unloading roving bobbins supported by a tip H upon the spaced transverse brackets F. The roving bobbins are self seating upon the spindles by virtue of enlarged tips I on the spindle blades insertable within the bobbin for camming the bobbin into position for positive drive adjacent the bobbin tips. A suitable monitoring device J is provided at each roving strand delivery for deactivating drive motors to an individual spindle and flyer combination to stop roving delivery to only one spindle and its bobbin.

The roving frame is illustrated as including suitable frame members comprising a cabinet 10 and Sampson in the form of a structural section 11 extending the length of the roving frame as frame members and act as supports for the transfer drive mechanism which moves the spindle rail rearwardly as well as imparting vertical transversing motion thereto. The roving is formed by attenuating sliver strands 13 which come from roving cans 14 spaced rearwardly of the roving frame and which pass over the bar 15 to a drafting system which includes a back roll 16 driven by a motor 17 supported in the cabinet 10 upon a base 18. The drafting system further includes the usual front roll 19 driven by the motor 20 carried upon a base 21. The roving strands **13*a* coming from the drafting system are fed to the respective flyers 22 which may be mounted upon a conventional support 23, upon the frame on a bracket 23*a*, to be individually driven by the motors 24 by suitable belts 25, FIG. 2. If desired, all of the flyers could be driven from a single tape 25*a* (FIG. 1-A) carried by the support 23 which has fixed connection, not shown, to the frame members. The flyers 22** distribute roving in the customary fashion to the roving bobbins A which are illustrated as including the tips H.

A single drive is illustrated as at D in the form of individual motors carried beneath the spindle rail driving each of the spindles independently of connection to any other drive mechanism. The motors D directly drive a respective spindle through a series of openings 26 carried in staggered spaced relation on the rail C. Alternatively, the independent drive may include a driven tape D' carried by the spindle rail C interconnecting the spindles B, and is thus free of any mechanical driving connection to any other drive mechanism (FIG. 1-A).

The drive mechanism E operates to impart a vertical traversing motion to the spindle rail C for building the full roving packages A and serves as a transfer drive to move the spindle rail rearwardly from beneath the spindles. The builder motion is imparted to the rail from a vertical traversing drive including the reversing motor 27 carried by the platform **27*a* mounted for movement together with the drive shaft 28 along the transverse structural frame members or Sampsons 12. A suitable drive train which may include a bevel gear 29 at each end drives a bevel gear 30 carried on a screw threaded member 31 to move the rail C passing through internally threaded members 32 up and down on the standards 33 which carry the screw 31 for rotation at the top in a bearing 34. The standards 33 are carried upon internally threaded slides 35 which carry the lower ends of the, standards 33 for rotation and supports the motor platform 27*a***.

The drive mechanism E further includes a transfer drive having a reversing motor 36 carried upon the platform 37 upon the machine frame. The motor 36 drives a shaft 38 which carries spaced bevel gears 39 which in turn may drive bevel gears 40 on the screw threads 41 which serve the transfer function imparting lateral translatory motion to the rail C through internal threads within the slides 35. The screw threads 41 are carried for rotation in bearings 42 at each end. Thus, the rail C is moved rearwardly to broken line position below the conveyor in FIGS. 1 and 2 and then, in the sequence described herein, upwardly in the direction of the arrows toward the conveyor by actuation of the vertical traversing drive.

The transverse brackets F are carried in spaced relationship on conveyor belts 43 having upper and lower runs as illustrated. The conveyor belts are mounted on drums 44 at each end and are moved for indexing and transporting by a suitable motor 45 upon a fixed platform 46. The brackets F receive full roving bobbins as when the rail C is in doffing or broken line position in FIG. 1 and as more fully explained below.

A pair of transfer arms G rotate in horizontal planes on respective sides of the transport conveyor and brackets F. The rotating G load and unload bobbins supported by the tip H The arms G are illustrated in FIG. 1 as unloading or transferring full bobbins shown in broken lines from the brackets F of the transport conveyor to pegs 47 carried upon an elevator platform 48 which is moved up and down on a vertical track 49 as by a linear actuator 50. Each of the arms G are carried by a vertical rotatable shaft 51. Rotation is imparted to the shafts 51 as by cylinders 52 which operate racks 53 to rotate pinions 54. Vertical motion is imparted to the shafts as by cylinders 55. As will be explained more fully below, the vertical stroke imparted to the transfer arms G may be limited by insertion of a spacer block 56 as by a cylinder 57.

The roving bobbins are self seating upon the spindles by means of the tips I at the top of the spindle blades insertable within the respective bobbins A for camming them into position for positive spindle drive exerted at the bobbin tips.

Figures 1A, 2:
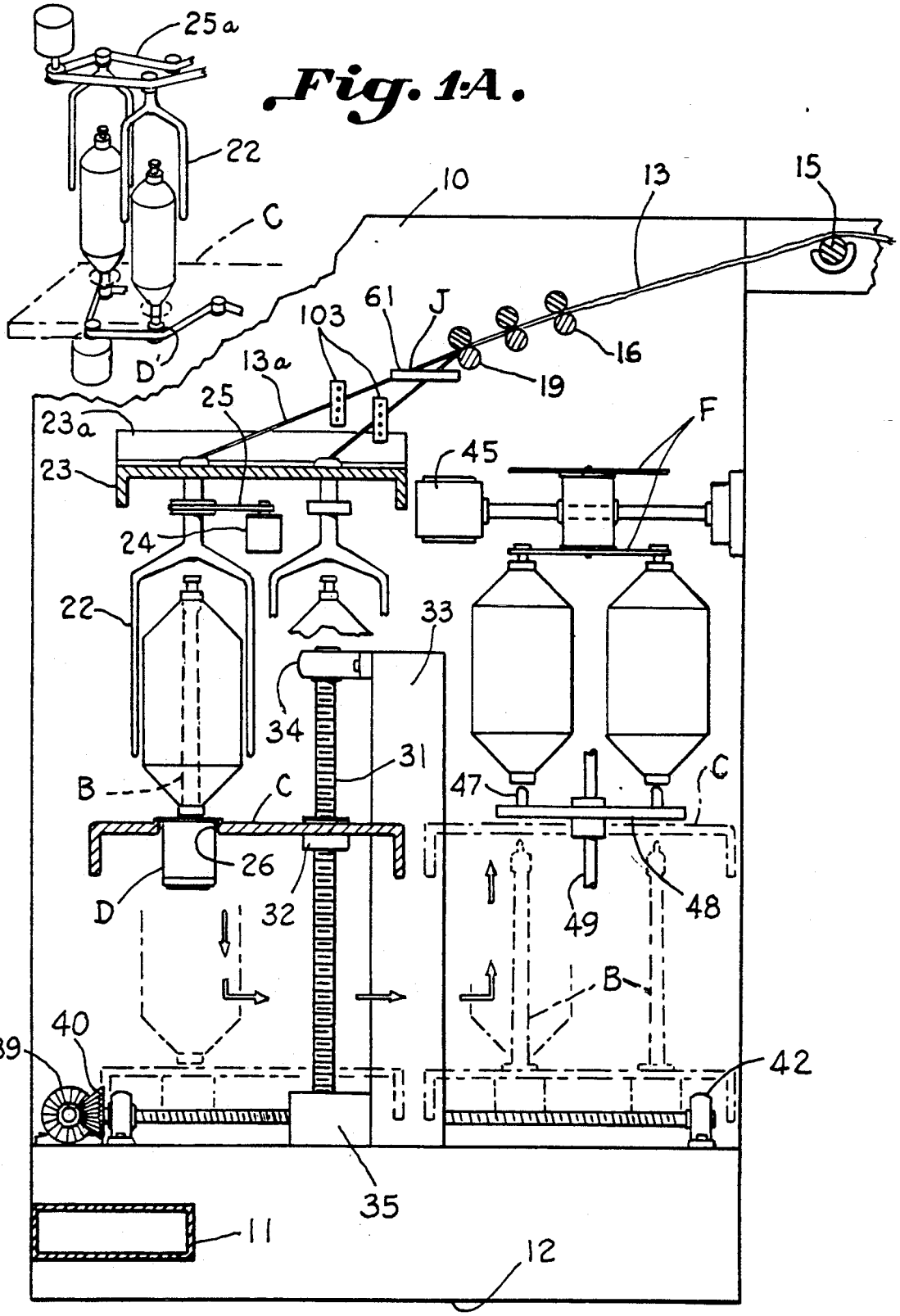
FIG. 2 is a transverse sectional elevation taken on the line 2—2 in FIG. 1 illustrating a spindle control constructed in accordance with the invention.

The monitoring device J may include a suitable sensing mechanism such as a light emitting diode 60 and receiver 61, FIGS. 1 and 2. By providing individual motor drives to the spindles and respective flyers, it is possible to control the manufacture of roving by stopping only one delivery when a faulty end occurs.

Figure 3:
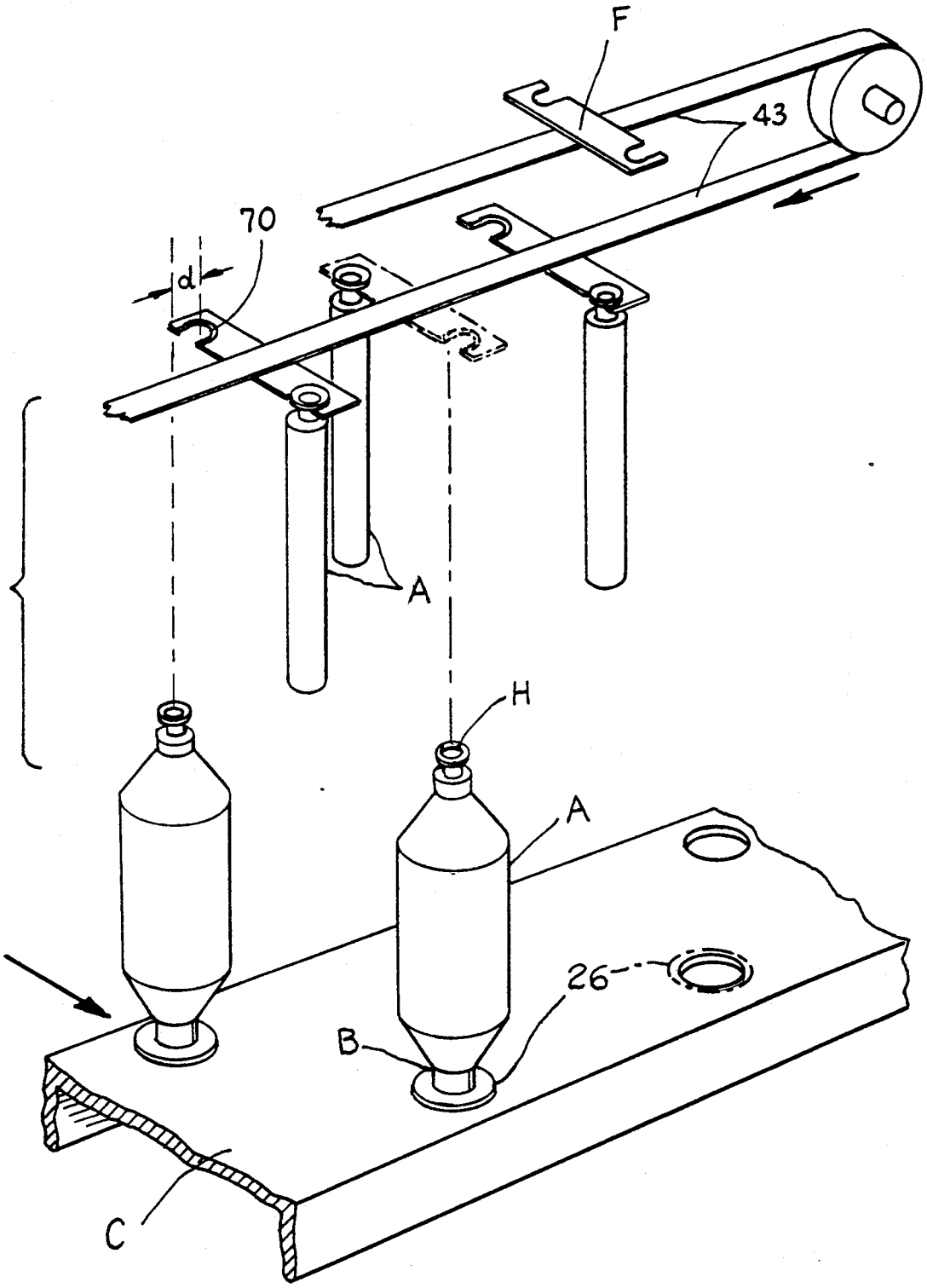
FIG. 3 is a schematic perspective view illustrating a roving bobbin transport conveyor with empty bobbins with the spindle rail moved rearwardly therebeneath preparatory to doffing full bobbins.

Referring more particularly to FIGS. 3–9, a sequence of doffing for bobbins and replacing the empty spindles upon a spindle rail with empty bobbins is illustrated. FIG. 3 illustrates the rail C rearward position looking from the rear with a back line of staggered spindles in the foreground. The bobbin transport means including the upper and lower run of the belt 43 carries the doffing brackets F in spaced relation with openings 70 for receiving bobbins within the transverse doffing brackets spaced slightly rearwardly of the tips H of the bobbins. The spindle rail C has been moved rearwardly in the direction of the arrow to doffing position.

Figure 4:
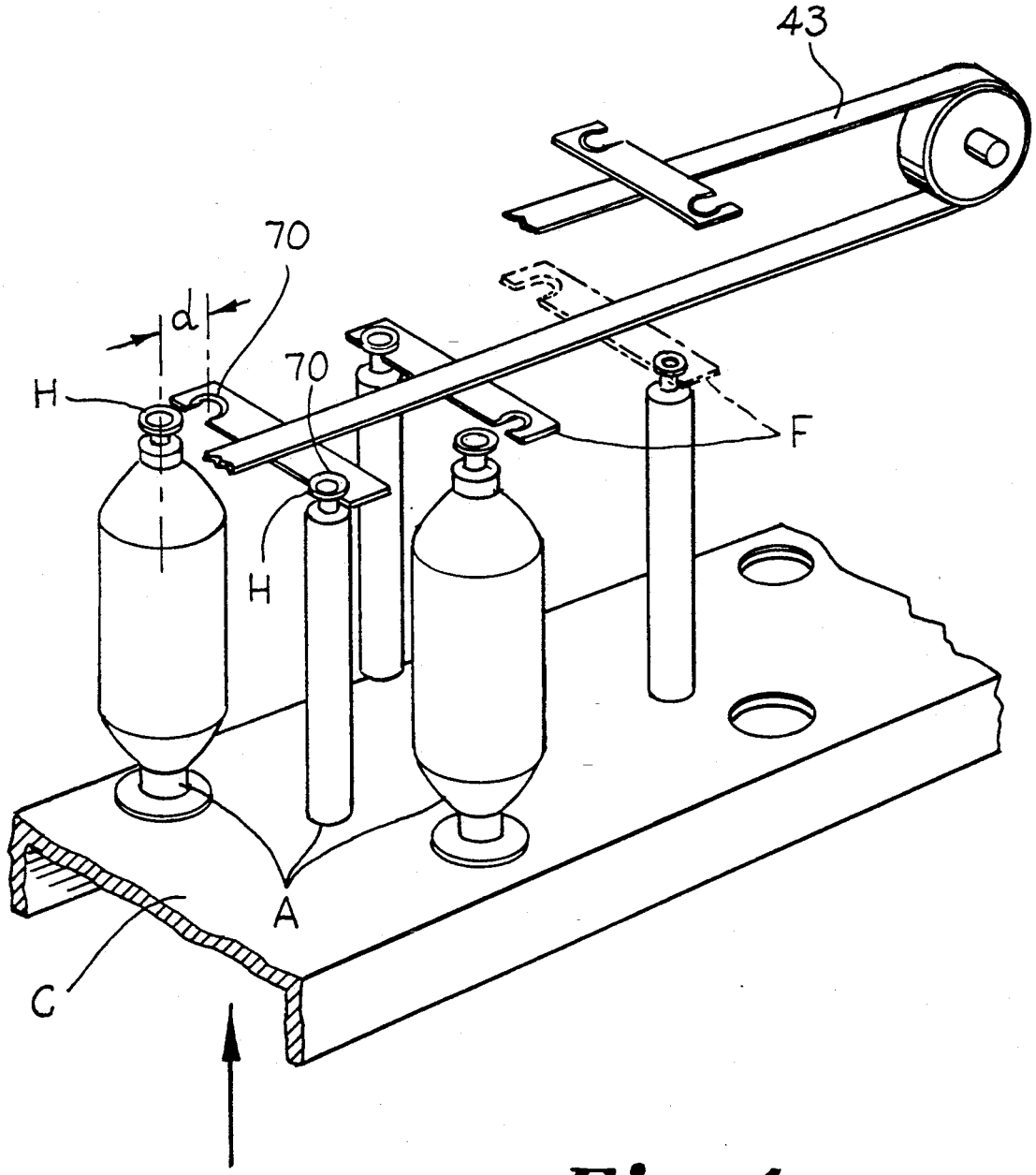
FIG. 4 is a perspective view of a first step in doffing wherein the spindle rail is moved upwardly until the tips of the full bobbins are horizontally aligned with the transverse doffing brackets.

FIG. 4 illustrates the spindle rail C in raised position with the tips H of the bobbins A in horizontal alignment forwardly of the transverse doffing brackets or hangers F. By indexing the transport conveyor forwardly by the distance "d", the full bobbins may be received within the openings 70 and opposite opening 70 carrying an empty bobbin by its tip H. Thus, the empty bobbins are held in staggered relation in openings 70 which alternate with the opening 70 receiving full bobbins.

Figure 5:
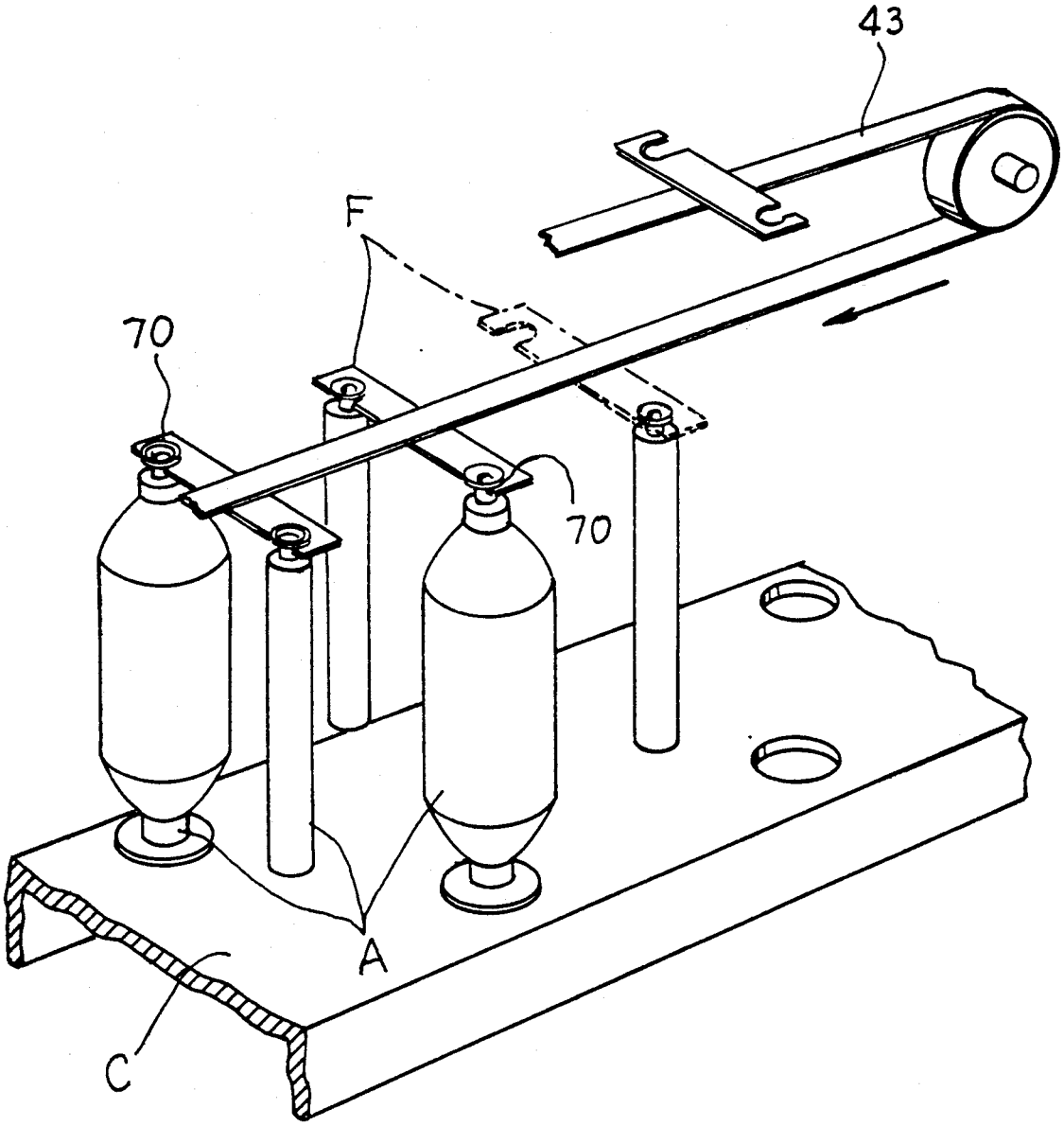
FIG. 5 is a perspective view illustrating the transport conveyor indexed forwardly engaging the tips of the bobbins.

FIG. 5 illustrates the conveyor as being indexed forwardly so as to receive the full bobbins within the staggered openings 70.

Figure 6:
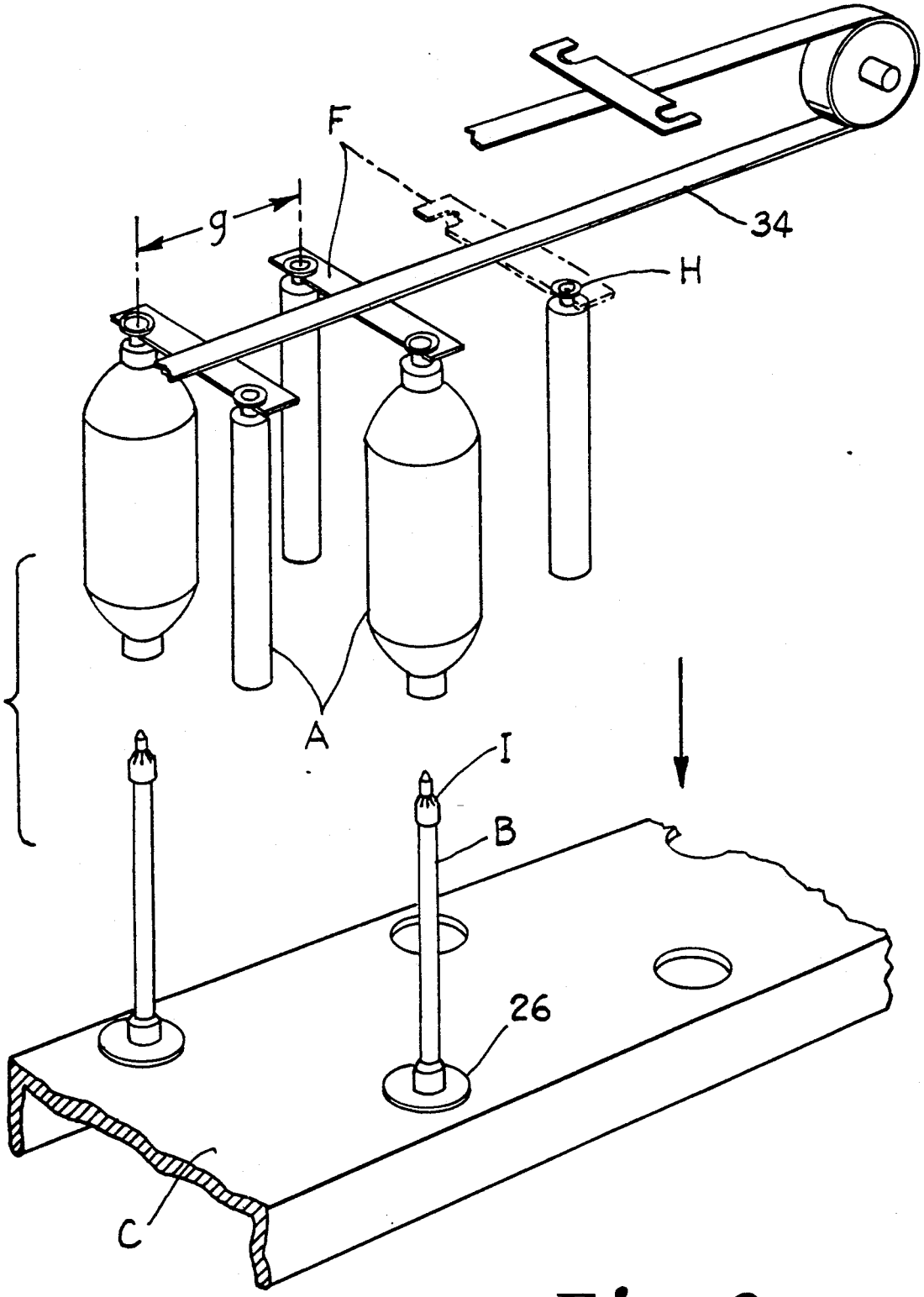
FIG. 6 is a perspective view illustrating the rail in lowered position with the full bobbins suspended from the transport conveyor.
Figure 7:
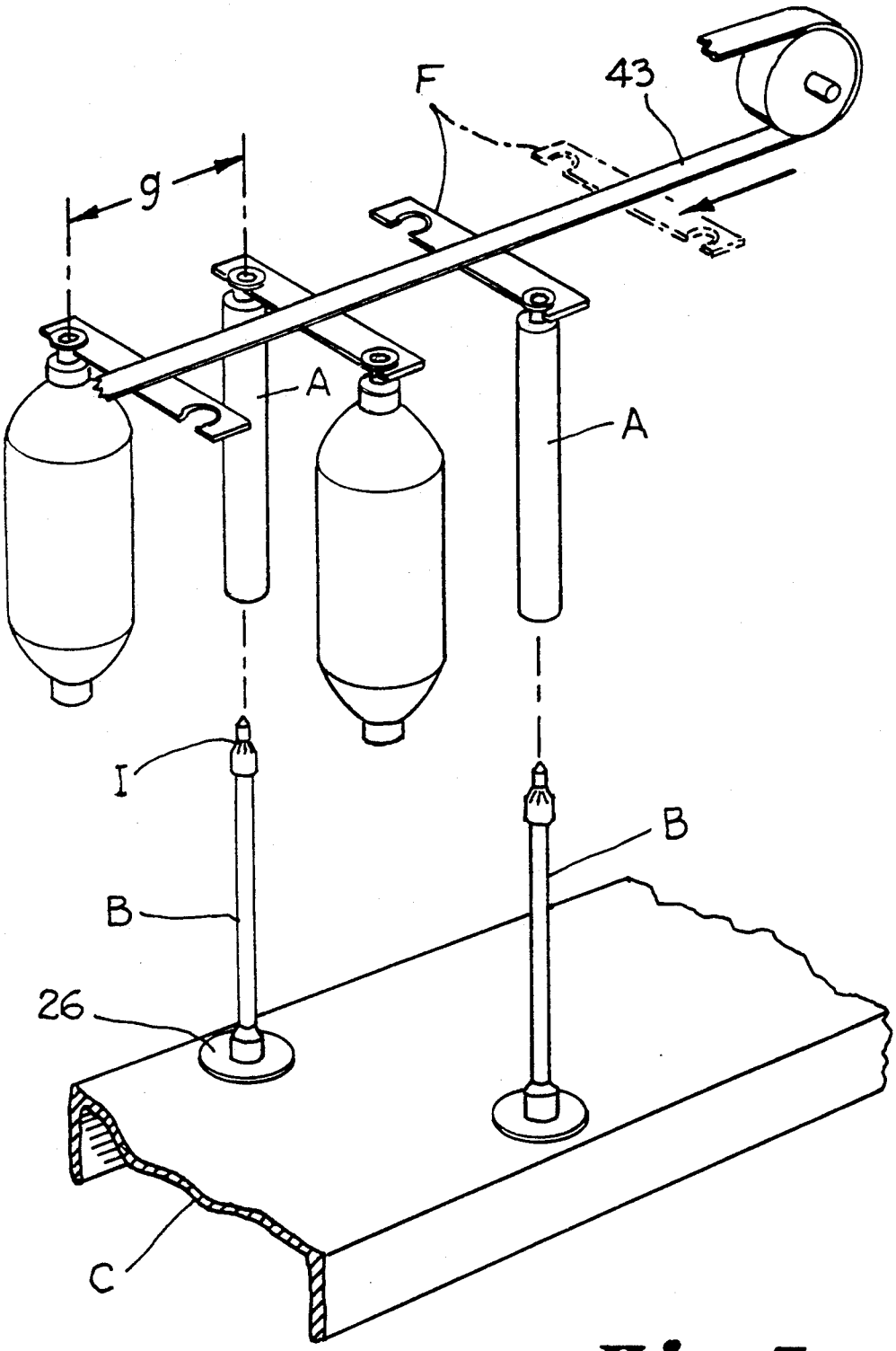
FIG. 7 is a perspective view illustrating a further forward indexing of the transport conveyor so that the staggered empty bobbins are aligned above the empty spindles.

FIG. 6 illustrates the spindle rail C as having been lowered so as to remove the full bobbin A from the spindle B. Referring to FIG. 7, the conveyor is now indexed forwardly for the amount of the distance "g" so as to place the empty spindle A directly over the staggered spindle B.

Figure 8:
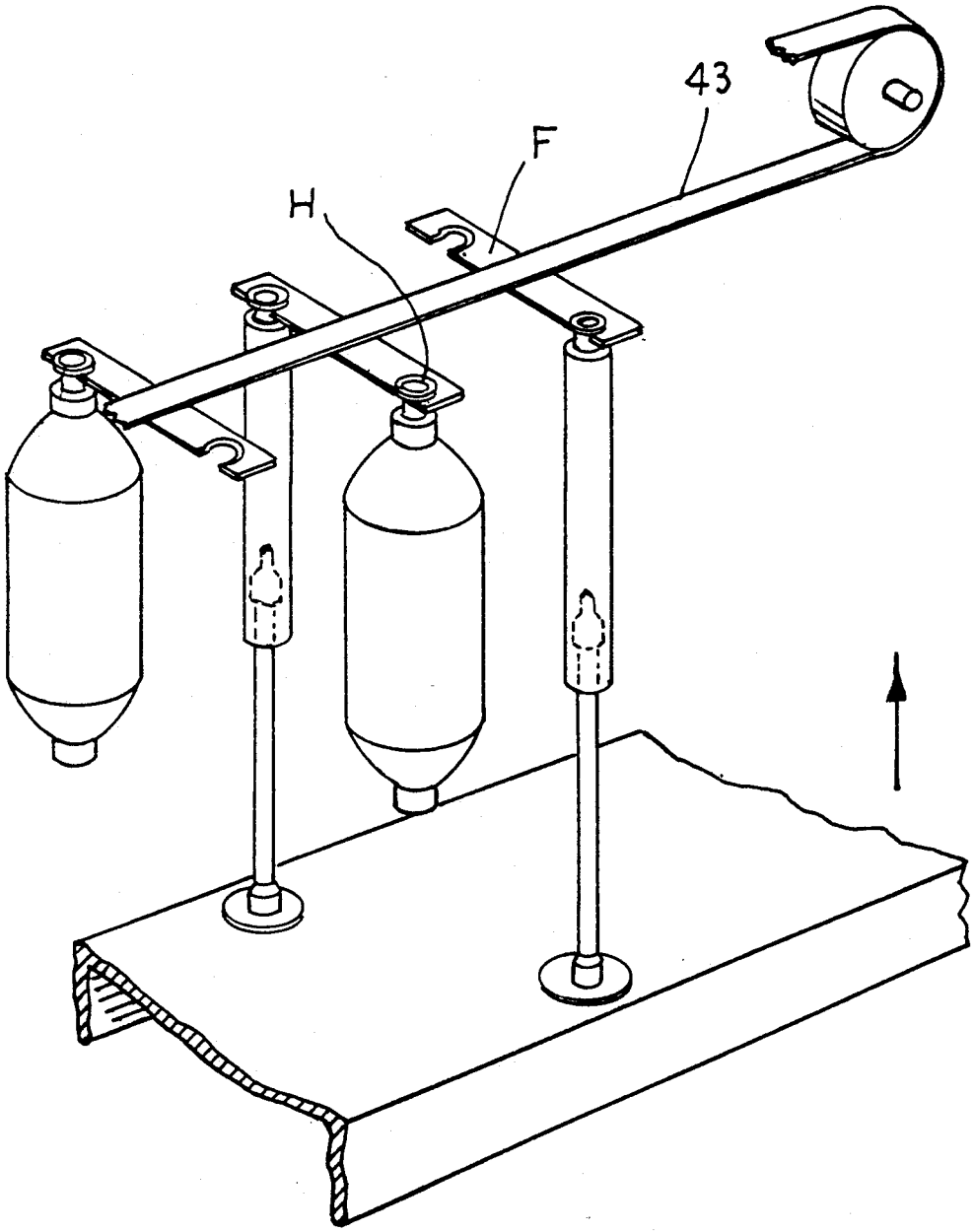
FIG. 8 is a perspective view illustrating the spindle rail raised so that the tips of the spindles have entered a lower end of the bobbins.

FIG. 8 illustrates the spindle rail again being raised until the tips I of the empty spindle have just entered a lower portion of the empty bobbin A.

Figure 9:
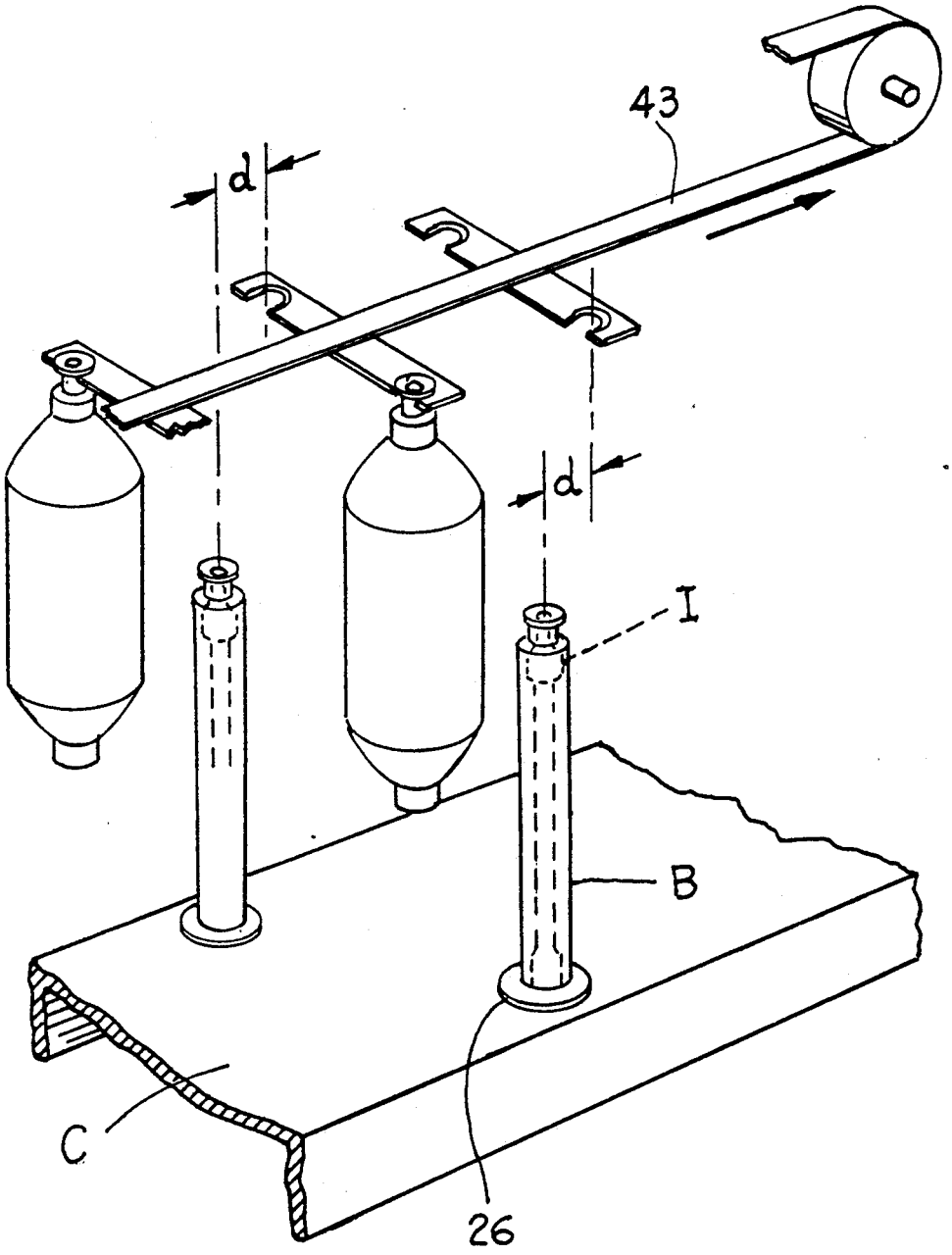
FIG. 9 is a perspective view illustrating the conveyor indexed rearwardly sufficiently to remove the empty bobbins from the doffing brackets after which the empty bobbins are self seated upon the spindles.

FIG. 9 illustrates the conveyor as being indexed rearwardly to dislodge the empty bobbins from the doffing brackets permitting them to fall in self seating engagement with the empty spindle B.

Figure 10:
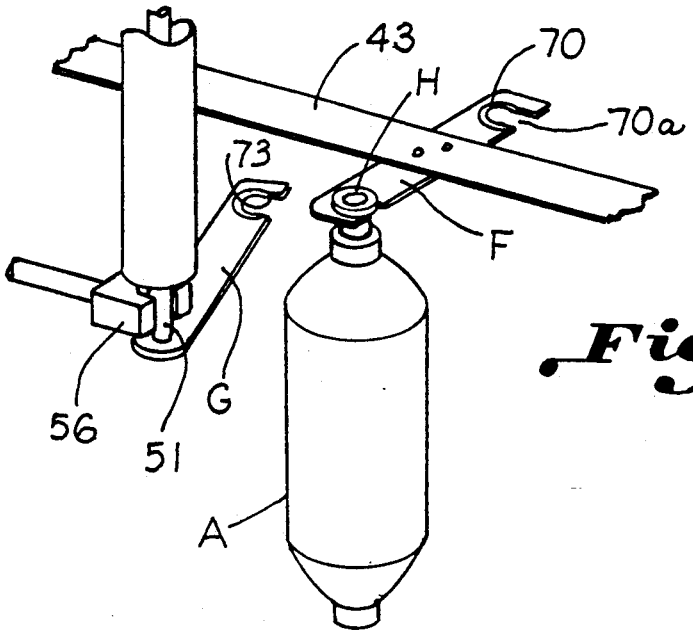
FIG. 10 is a schematic perspective view illustrating the first step in an operation transferring or doffing a full bobbin from the transport conveyor wherein a transfer arm passes beneath the doffing bracket to remove a full bobbin.
Figure 11:
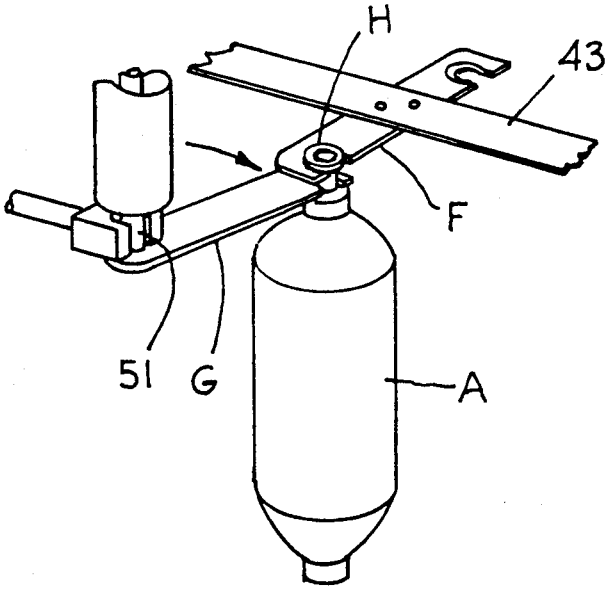
FIG. 11 is a perspective view illustrating removal of a full bobbin through an opening in a leading edge of the doffing bracket.
Figure 12:
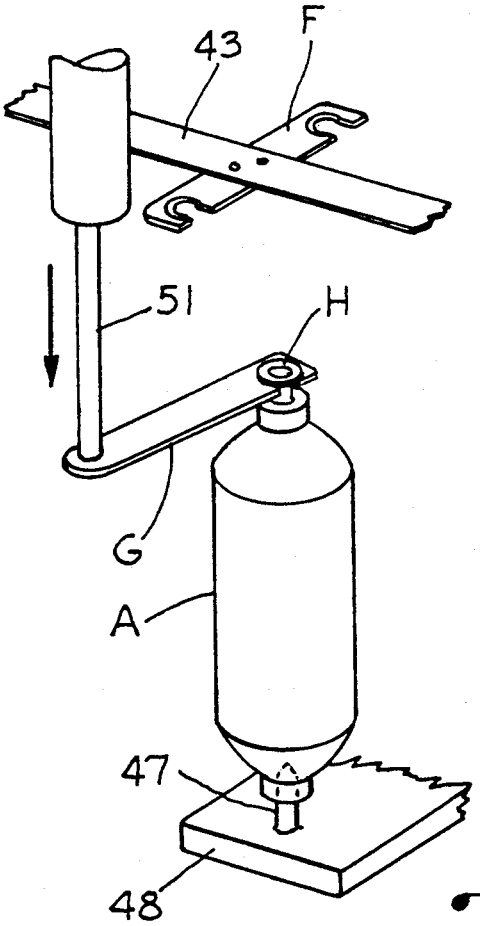
FIG. 12 is a perspective view illustrating the transfer arm lowering the full bobbin upon a pin carried by an elevator platform.
Figure 13:
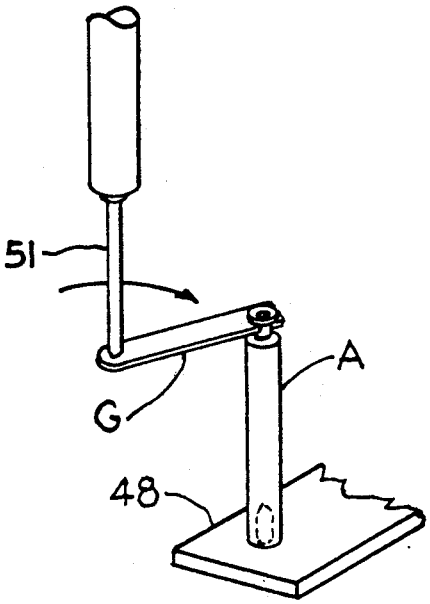
FIG. 13 is a schematic perspective view illustrating a first step in the loading of empty bobbins upon the transport conveyor, wherein the transfer arm rotates to engage an empty bobbin carried by the elevator platform.

Referring more particularly now to FIGS. 10–12, the doffing of full bobbins and placement thereof upon pegs 47 carried by the elevator platform 48 is illustrated. The transfer arms G have an open receptacle 73 for receiving the tips H of full bobbins by passing beneath the doffing brackets F which hold the full bobbins in suspended relationship. It will be noted that the spacer block 56 is inserted so as to limit the upwardly stroke of the arm 51 thus insuring that the transfer arm will pass beneath the doffing bracket F so as to be in a position to remove the full bobbin from the open side **70*a* of the receptacle 70. FIG. 11 illustrates the arm G in position beneath the bracket F engaging the full bobbin at its tip. FIG. 12 illustrates rotatable arm 51 as being lowered and rotated so as to place the full bobbin A upon the peg 47 and the arm is rotated away from the bobbin. The full bobbins are then transported upwardly by the elevator platform 48** beneath a suitable conveyor to carry roving to tis next placement as at a spinning frame.

Figure 14:
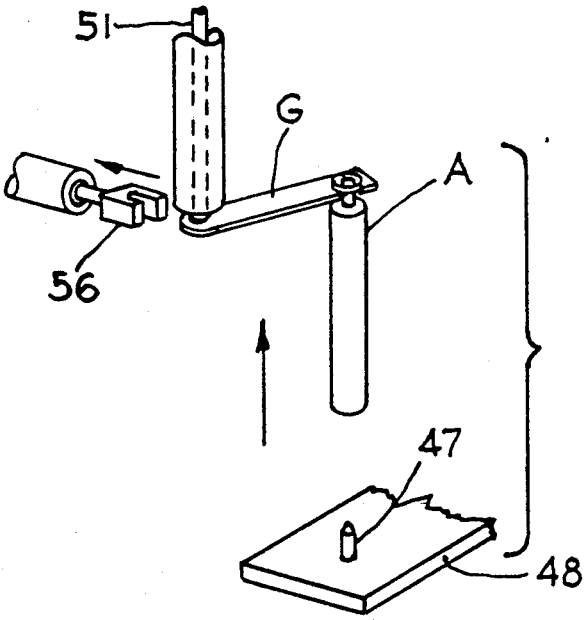
FIG. 14 is a perspective view illustrating a transfer arm elevated through a full stroke raising an empty bobbin from the elevator platform.

Referring to FIGS. 13–17, a loading operation is illustrated wherein empty bobbins A are removed from an elevator platform and positioned within a staggered relationship upon the transverse doffing brackets or hangers F. The rotating shaft 51 is raised from position shown in FIG. 13 to elevate the bobbin through a full stroke as illustrated in FIG. 14, the spacer block 56 having been withdrawn so as to insure the fact that the upper arm will pass over the doffing bracket F.

Figure 15:
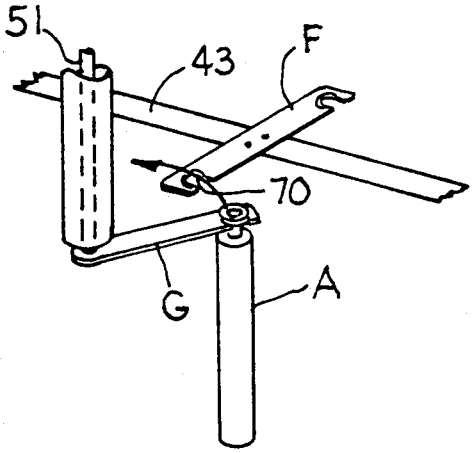
FIG. 15 is a perspective view illustrating the transfer arm rotated aligning the empty bobbin for reception in the conveyor bracket.
Figure 16:
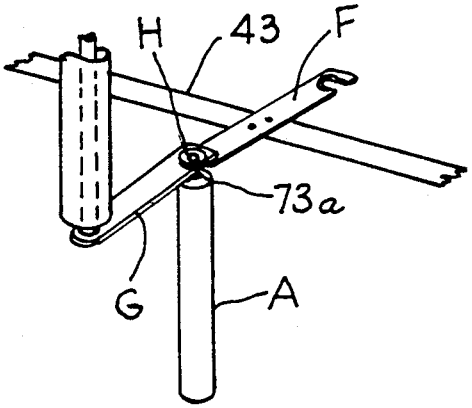
FIG. 16 is a perspective view illustrating the conveyor bracket beneath the transfer arm which rotates above the doffing bracket for positioning an empty bobbin on the conveyor.

FIG. 16 illustrates the transfer arm G as being rotated passing over the bracket F and inserting the empty bobbin into the recess 70 as illustrated in FIG. 15.

Figure 17:
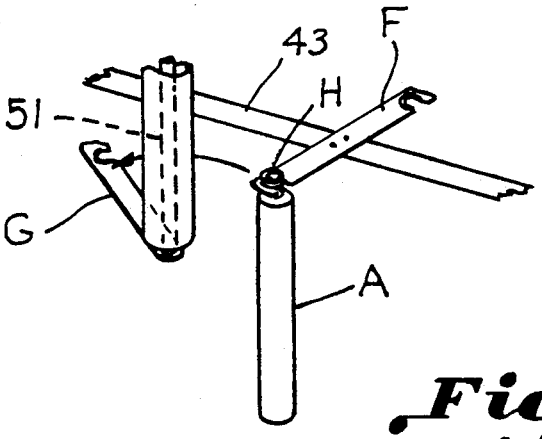
FIG. 17 is a perspective view looking from above the transport conveyor illustrating an empty bobbin or tube suspended or hanging freely from the conveyor bracket.

FIG. 17 illustrates removing the empty bobbin from the opening side **73*a* of the arm G by further rotation of the shaft 51**.

Figure 18:
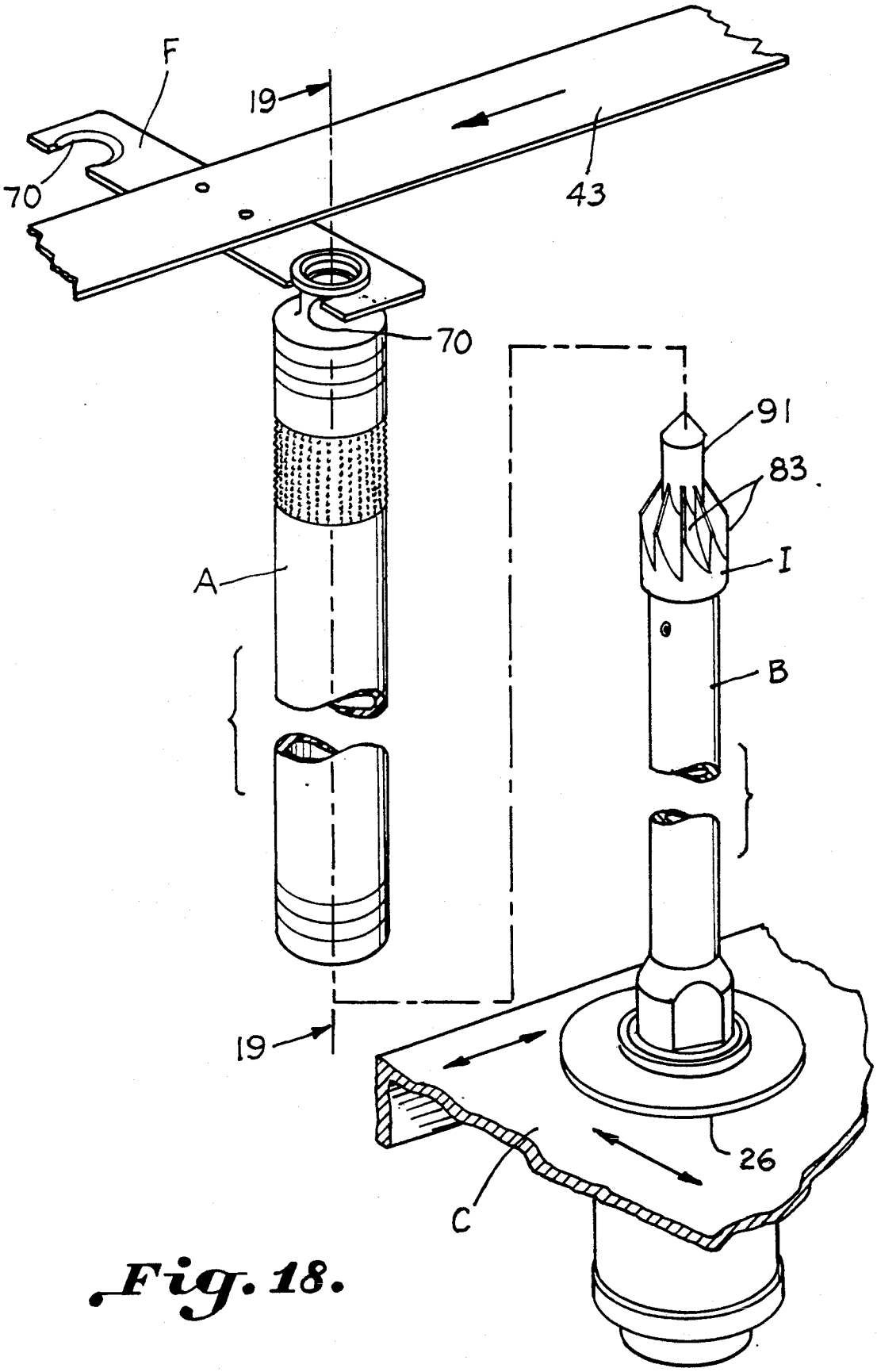
FIG. 18 is an enlarged perspective view illustrating a roving bobbin constructed in accordance with the invention suspended from a doffing bracket and a spindle having a tip for seating and driving the bobbin.
Figure 19:
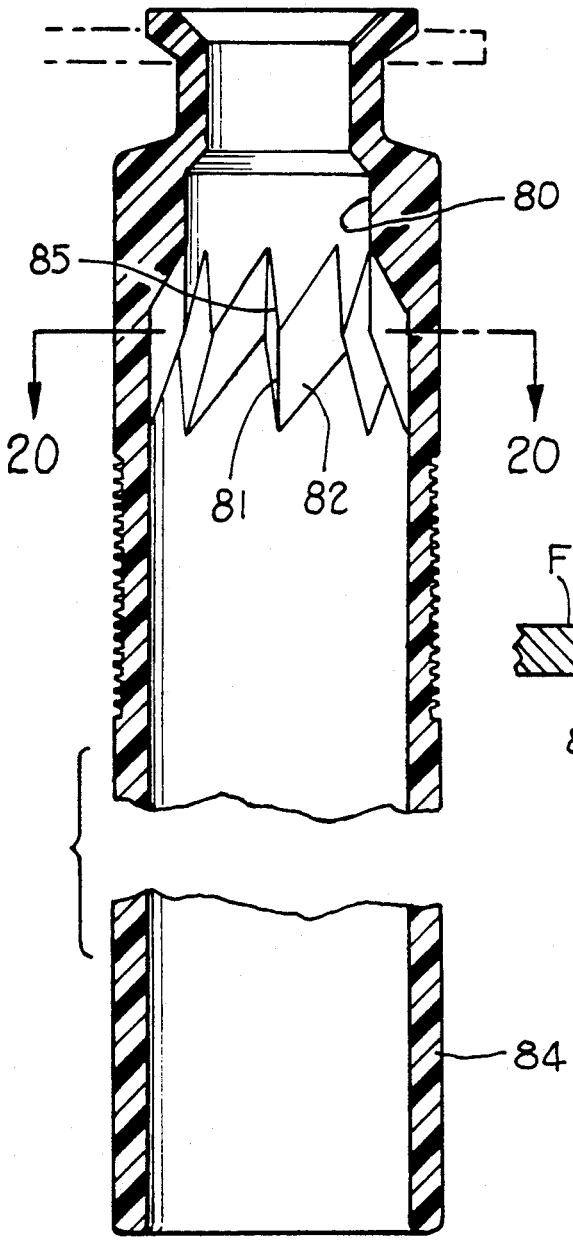
FIG. 19 is a transverse sectional elevation taken on the line 19—19 in FIG. 18.
Figure 20:
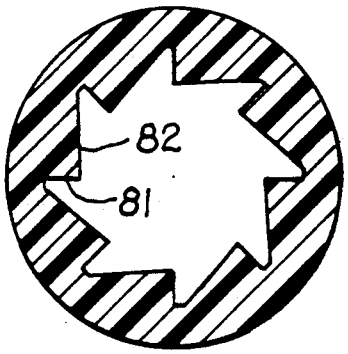
FIG. 20 is a sectional plan view taken on the line 20—20 in FIG. 19.
Figure 21:
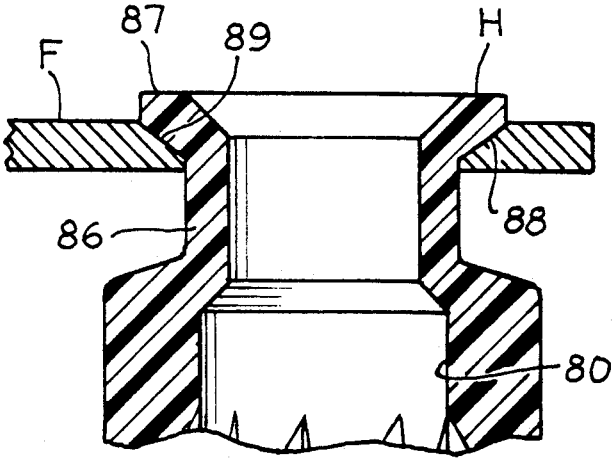
FIG. 21 is an enlarged sectional elevation of a tip of a roving bobbin carried in a doffing bracket.

FIG. 18 illustrates a transport conveyor carrying an empty bobbin A within the recess 70. The bobbin is in position to be received upon a spindle B engaging the enlarged tip I preparatory to self seating. The bobbin is illustrated in FIG. 19 as having an enlarged inner upper tip portion illustrated at 80 carrying a plurality of downwardly tapered surfaces including a surface 81 inclined downwardly and outwardly to insure vertical alignment in respect to the longitudinal axis of the spindle. A camming surface 82 tapers across a longitudinal axis of the bobbin and is provided to rotate the bobbin when it engages the spaced serrations 83 of the enlarged spindle tip I. It will be noted that the bobbin is a unitary molded member as being constructed of suitable plastics such as polyethylene and the like having an open barrel 84. A plurality of driving surfaces 85 are provided opposite the camming surfaces 82. The bobbin has a further tip portion H which includes a restricted neck 86 having an inwardly extending flange 87 carried thereby. The flange 87 has an inwardly tapering lower surface 88 for engagement with an outwardly tapering surface 89 carried by the opening within the doffing brackets F.

Referring now more particularly to FIGS. 22-25, a sequence wherein the bobbin is self seating upon the spindle is illustrated. The bobbin A first engages the spindle tip at a number of spaced points 90 about the enlarged inner portion of the bobbin 80. The serrations 83 of the spindle have scalloped or fluted surfaces which are complementary to the camming and driving surfaces described above in connection with a lower downwardly extending portion adjacent at the tip. It will be noted that a reduced guiding portion of the tip 91 extends above the upwardly and inwardly tapering serrations 83 of the enlarged spindle tip I.

FIG. 23 is a sectional plan view taken on the line 23-23 in FIG. 22 illustrating the driving surfaces of the bobbin A and the spindle enlargement I as being out of contact.

FIG. 25 is a sectional plan view taken on the line 25—25 in FIG. 24.

Figure 28:
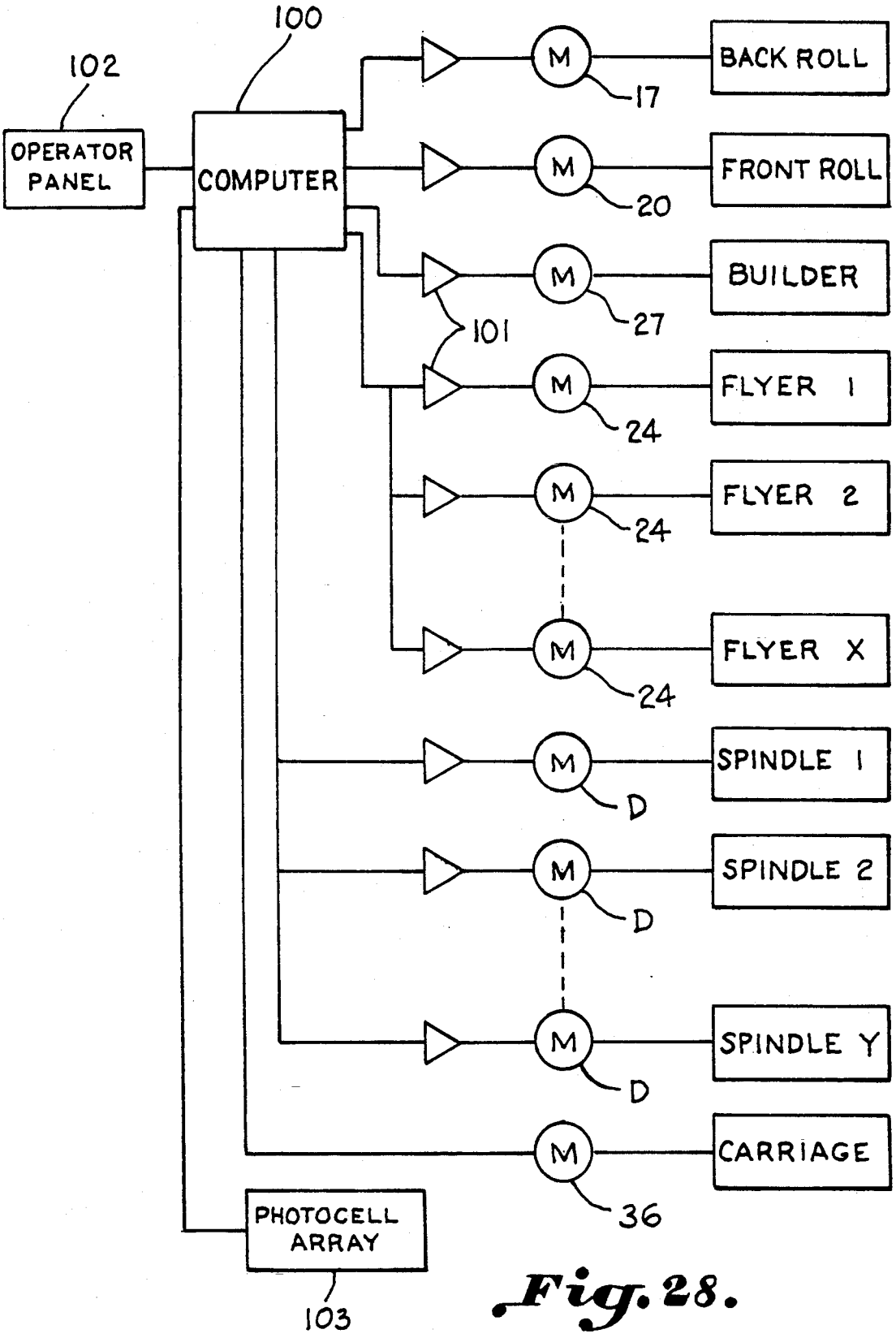
FIG. 28 is a block diagram illustrating controls for the roving frame.

Each motion or drive of the roving frame including builder drive motors 27, spindle drive motors D, flyer drive motors 24 and back and front roll motors 17 and 20, are directly controlled by a suitable computer program. An output is provided for the computer 100 for each drive device as illustrated in FIG. 28. Such controls eliminate all mechanical drive connections on the frame. Speed and position relationship of the various drives and components are in the computer's memory. The program is executed by the computer sending the appropriate signals to the respective drive motors. The computer also determines if all elements are operating properly, and if not, it takes whatever action is necessary. The motors are supplied power by suitable amplifiers 101 with feedback from the motors such that the speed and position of the components are known at all times.

The computer is connected to an operator interface panel 102 for deploying operation conditions at the frame.

The computer is made up of several processors with each used to coordinate the functions of all of the processors.

The signal from a photo cell sensor array 103 (FIGS. 2 and 28) tells the computer that the roving being delivered from the front roll to the flyer is too slack or excessively tensioned and, therefore, the bobbin speed must be increased or decreased at each respective delivery. Such sensors have been utilized in electronic control Type 1506 by Textima of Berlin, Germany to control roving tension.

Figures 26, 27:
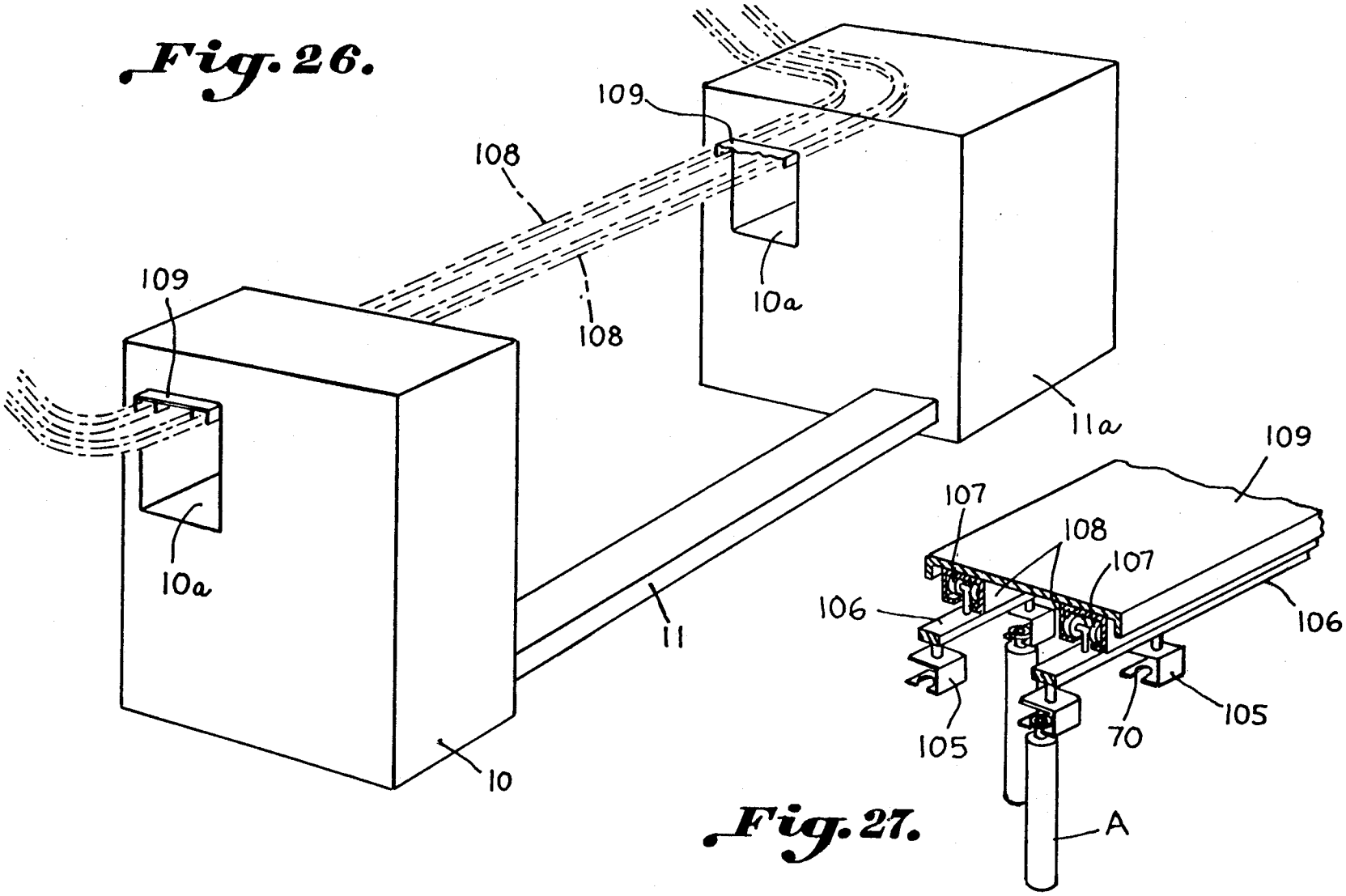
FIG. 26 is a perspective view schematically illustrating a bobbin transport mechanism constructed according to a modified form of the invention carried on a roving frame.
FIG. 27 is an enlarged perspective view illustrating empty bobbins transported upon carriages.

FIGS. 26 and 27 illustrate an alternate form of the invention wherein bobbin transport mechanism moves from a point of delivery as, for example, a spinning frame (not shown). The roving frame includes the cabinet 10 joined as by the structural section 11 to another cabinet **11*a* at an opposite end of the roving frame. Openings 10*a* are provided in respective cabinets to accommodate the bobbin transport mechanism provided in the form of individual carriages 105 having openings as at 70. Articulated links 106 are carried upon rollers 107 in the tracks 108 on the inverted channel 109**.

Preferably the carriages are moved in one direction, but it may be advantageous to move them in an opposite direction as, for example, backing them up for loading empty bobbins.

Indexing mechanism may be provided as described above. An advantage of the modified version of the transport mechanism is the avoidance of a transfer and unloading station as is necessitated at an end of the frame as illustrated in FIG. 1.

While a preferred embodiment of the invention has been described using specific terms, such description is for illustrative purposes only, and it is to be understood that changes and variations may be made without departing from the spirit or scope of the following claims.

What is claimed is:

1. A roving frame having a spindle rail and flyers in vertical alignment therewith comprising:

a movable conveyor;

a plurality of longitudinally spaced doffing means having a bobbin receiving receptacle carried by said conveyor;

a drive mechanism including a transfer drive moving said rail to a doffing position out of vertical alignment with said flyers;

a vertical traversing drive moving said rail upwardly in respect to said conveyor when in doffing position; and an indexing drive moving said conveyor and said doffing means carried thereby longitudinally in increments in respect to said rail.

2. The structure set forth in claim 1 wherein empty bobbins are carried in one of said receptacles of said doffing brackets in staggered relation.

3. The structure set forth in claim 1 wherein said rail is moved to doffing position by effecting rearward movement thereof toward a source of textile strands.

4. The structure set forth in claim 1 wherein said vertical traversing drive moves said rail upwardly so that said doffing means is in alignment with and closely adjacent bobbins for doffing.

5. The method of making roving utilizing a drafting system for attenuating a sliver strand and a transversing spindle rail carrying spindles upon which roving is distributed from flyers comprising the steps of:

moving said spindle rail downwardly and rearwardly toward a source of textile strands to a doffing position back of said flyers; and providing a transport device above said spindle rail when in said doffing position;

said rail when in said doffing position being in alignment with said transport device for reception of full bobbins thereby directly from said traversing rail.

* * * * *